US006349873B1

(12) United States Patent
Slater

(10) Patent No.: US 6,349,873 B1
(45) Date of Patent: Feb. 26, 2002

(54) ABOVE GROUND STORAGE TANK FOR HOLDING COMBUSTIBLE MATERIAL AND SUPPORTING EQUIPMENT THEREON

(76) Inventor: Electus P. Slater, 4626 Nottingham Rd., Jacksonville, FL (US) 32210

( * ) Notice: Subject to any disclaimer, the term of this patent is extended or adjusted under 35 U.S.C. 154(b) by 0 days.

(21) Appl. No.: 09/465,347

(22) Filed: Dec. 16, 1999

Related U.S. Application Data

(63) Continuation-in-part of application No. 09/213,407, filed on Dec. 17, 1998, now Pat. No. 6,026,975.

(51) Int. Cl.[7] ..... B23K 31/02

(52) U.S. Cl. ..... 228/184; 220/62.15; 220/62.17; 220/565; 220/567.2; 220/592.25; 220/651

(58) Field of Search ..... 228/184; 220/565, 220/567.2, 592.26, 592.25, 62.15, 62.17, 651

(56) References Cited

U.S. PATENT DOCUMENTS

| | | | | |
|---|---|---|---|---|
| 1,100,804 A | | 6/1914 | White | |
| 2,485,647 A | | 10/1949 | Norquist | 220/592.26 |
| 2,673,454 A | | 3/1954 | Gallie | 220/592.2 |
| 2,677,571 A | | 5/1954 | Williams | 296/24 |
| 2,684,173 A | | 7/1954 | Schmitz | 220/565 |
| 3,044,540 A | | 7/1962 | Hammersley | 160/20 |
| 3,123,186 A | | 3/1964 | Adkinson et al. | 189/34 |
| 3,267,626 A | | 8/1966 | Daly | 52/145 |
| 3,305,986 A | | 2/1967 | Mathews | 52/270 |
| 3,472,033 A | | 10/1969 | Brown | 220/565 |
| 3,492,767 A | | 2/1970 | Pincus | 52/79 |
| 3,498,011 A | | 3/1970 | Lindgren | 52/31 |
| 3,633,324 A | | 1/1972 | Cuylits et al. | 52/66 |
| 3,667,172 A | | 6/1972 | Erickson | 52/64 |
| 3,946,528 A | | 3/1976 | Jacobson et al. | 52/79 |
| 4,014,143 A | | 3/1977 | Purceil | 52/90 |
| 4,065,022 A | | 12/1977 | Cainaud | 220/647 |
| 4,136,493 A | * | 1/1979 | Bradford et al. | |
| 4,221,093 A | | 9/1980 | Crookston | 52/269 |
| 4,388,810 A | | 6/1983 | Guilhem | 62/54.3 |
| 4,394,809 A | | 7/1983 | Sherwood et al. | 52/515 |
| 4,455,801 A | | 6/1984 | Merritt | 52/309 |
| 4,615,166 A | | 10/1986 | Head | 52/309 |

(List continued on next page.)

FOREIGN PATENT DOCUMENTS

| | | | |
|---|---|---|---|
| DE | 3329-620 A | 3/1985 | 52/143 |
| EP | 0 381 273 | 1/1990 | |
| FR | 1134409 | 12/1956 | 52/68 |
| IT | 559004 | 3/1957 | 52/68 |
| IT | 607691 | 9/1960 | 52/68 |

OTHER PUBLICATIONS

International Search Report for PCT/US99/29803 mailed Oct. 12, 2000.

Brochure entitled "The Phoenix Envirovault Offers the Ultimate Protection" (1992).

Ardizzone et al. "System 12 Containerized Exchange" *Electrical Communication*, vol. 59, No. 1/2 pp. 207–211, (1985).

*Primary Examiner*—Tom Dunn
*Assistant Examiner*—Kiley Stoner
(74) *Attorney, Agent, or Firm*—Kilyk & Bowersox, PLLC

(57) ABSTRACT

An above ground storage tank for holding combustible material and for supporting equipment thereon, such as an electric power generator, has an inner tank with a bottom wall, opposed side walls, opposed end walls and a top wall preferably formed as metallic skins, the inner tank top and bottom walls having stiffening members, which is enclosed and supported in an outer tank having a bottom wall, opposed side walls, and opposed end walls, formed as metallic skins. A barrier insulation is preferably provided between the inner and outer tanks and mounting members are provided on top of the assembly to support equipment on the above ground storage tank.

15 Claims, 4 Drawing Sheets

U.S. PATENT DOCUMENTS 4,805,357 A 2/1989 Aleixo ..... 52/79.14
4,854,094 A 8/1989 Clark ..... 52/79.14
4,959,504 A 9/1990 Yarger et al. ..... 174/35
4,963,082 A * 10/1990 Lindquist et al.
4,989,750 A 2/1991 McGarvey ..... 220/444
5,004,632 A 4/1991 McGarvey et al. ..... 427/410
5,012,949 A 5/1991 McGarvey et al. ..... 220/455
5,038,456 A 8/1991 McGarvey ..... 29/460
5,082,138 A 1/1992 McGarvey ..... 220/444
5,092,024 A 3/1992 McGarvey ..... 29/460
5,103,996 A 4/1992 McGarvey ..... 220/455
5,113,625 A 5/1992 Davis ..... 52/143
5,232,119 A * 8/1993 Kauffman
5,249,698 A * 10/1993 Cruver et al.
5,251,473 A * 10/1993 Reese
5,282,546 A 2/1994 Bauer ..... 220/565
5,285,920 A 2/1994 McGarvey ..... 220/444
5,315,794 A 5/1994 Pearson ..... 52/79.14
5,449,081 A 9/1995 Sjostedt et al. ..... 220/1.5
5,495,695 A 3/1996 Elliott, Jr. ..... 220/565
5,560,150 A 10/1996 Pearson ..... 52/79.14
5,564,588 A * 10/1996 Reese
5,601,204 A 2/1997 Hall ..... 220/469
5,755,062 A 5/1998 Slater ..... 52/79.14
5,884,709 A 3/1999 Evans et al. ..... 220/565
6,026,975 A 2/2000 Slater ..... 220/565
6,039,123 A * 3/2000 Webb
6,257,437 B1 * 7/2001 Slater

* cited by examiner

ABOVE GROUND STORAGE TANK FOR HOLDING COMBUSTIBLE MATERIAL AND SUPPORTING EQUIPMENT THEREON

This application is a continuation-in-part of U.S. patent application No. 09/213,407 filed Dec. 17, 1998, now U.S. Pat. No. 6,026,975, which is incorporated herein in its entirety by reference.

BACKGROUND OF THE INVENTION

The present invention relates to a structure for the containment of a combustible material. The present invention is particularly advantageous in that it provides a tank for storage of a combustible material and for the supporting of equipment, such as an electric power generator, on the tank, which equipment can be fueled by the combustible material stored in the tank.

Above ground storage tanks for combustible liquids, such as petroleum products, for use with equipment, such as auxiliary electric power generators, are used where such equipment is located. For example, emergency electric generators are required in connection with hospitals, nursing homes, businesses and other facilities where the loss of electrical power from a primary source may result. In order to operate such emergency electric generators, a source of fuel is needed at the site. Storage tanks for the fuel are thus required in conjunction with the emergency equipment itself. Such tanks must be fire resistant and are also preferably impact resistant. The use of above ground storage tanks are preferred over below ground storage tanks in order to avoid problems of installation of such below ground tanks and also problems associated with possible leakage of combustible material from an underground storage tank. Problems associated with underground storage tanks for combustible materials and structures that are usable as above ground storage tanks are discussed, for example in U.S. Pat. Nos. 4,989,750; 5,004,632; 5,012,949; 5,038,456; 5,082,138; 5,092,024; 5,103,996; and 5,282,546.

It is an object of the present invention to provide an above ground storage tank for combustible material that will not only provide a fireproof storage tank for the combustible material, such as fuel, but will also provide a support for equipment, for which the fuel is intended.

SUMMARY OF THE INVENTION

Accordingly, the present invention is directed to a structure and method of manufacture of a structure that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure and method particularly pointed out in the written description and claims hereof as well as the appended drawings.

To achieve these and other advantages and in accordance with the purpose of the invention, as embodied and broadly described, the structure of the invention is an above ground storage tank for a combustible material, such as a liquid combustible fuel, and for supporting equipment, such as an electric power generator, on the storage tank. The storage tank includes an inner tank, for the containment of a combustible material, that has a bottom wall, opposed side walls, opposed end walls and a top wall, which are preferably formed of a metallic skin and welded together. A plurality of inner tank bottom wall stiffening members are spaced along the bottom wall which extend substantially completely across the bottom wall of the inner tank, and a plurality of inner tank top wall stiffening members are spaced along the top wall which extend substantially completely across the top wall of the inner tank. The storage tank also includes an outer tank, that encloses the inner tank, the outer tank having a bottom wall, opposed side walls, opposed end walls and a top wall, all of which are formed of a metallic skin. The top wall has an inner and outer surface, a plurality of outer tank top wall stiffening members spaced along the top wall which extend substantially completely across the top wall and a plurality of outer tank side wall stiffening members that are preferably aligned with the outer tank top wall stiffening members and extend vertically substantially completely downwardly along the side walls. Support members are disposed between the bottom wall of the inner tank and the bottom wall of the outer tank which support the inner tank within the outer tank so as to provide an insulating gap about the inner tank between the inner tank and outer tank, which insulating gap is preferably filled with a barrier insulation. In order to support equipment on the above ground liquid storage tank, a plurality of mounting beams are provided which extend along the outer surface of the outer tank top wall.

The inner tank top wall is preferably a metallic skin with the stiffening members preferably being U-shaped metallic members welded to the inner surface of the top wall and the inner tank bottom wall is preferably a metallic skin with the stiffening members preferably being U-shaped metallic members welded to the inner surface of the bottom wall, while the outer tank top wall stiffening members preferably are U-shaped metallic members welded to the inner surface of the top wall and the outer tank side wall stiffening members are also preferably U-shaped metallic members which are welded to the inner surface of the side walls. The plurality of mounting beams are preferably welded to the outer surface of the outer tank top wall and most preferably include electric power generator mounting beams, with a plurality of mounting tabs provided on the top wall, spaced outside the mounting beams for securement of a housing to enclose an electric power generator mounted on the mounting beams.

In another aspect, the invention is a method of fabricating an above ground storage tank, for holding a combustible material and for supporting equipment thereon by the steps of providing an inner tank for containment of a combustible material, the inner tank having a bottom wall, opposed side walls, opposed end walls and a top wall, all of which are preferably formed from a metallic skin, with a plurality of inner tank bottom wall stiffening members spaced along the bottom wall extending substantially completely across the bottom wall and a plurality of inner tank top wall stiffening members spaced along the top wall extending substantially completely across the top wall; providing an outer tank bottom wall having spaced cradles on an upper surface thereof, with opposed vertically upwardly extending side walls and end walls, the side walls and end walls welded to the bottom wall about the periphery thereof and to each other to form a cavity; positioning the inner tank in the cavity and on the cradles so as to provide an insulating gap between the inner tank and the bottom wall, side walls and end walls of the outer tank with an insulating gap also provided between the top wall of the inner tank on a plane formed across the upper edges of the side walls and end walls of the outer tank; welding a top wall to the upper edges of the side walls and end walls of the outer tank so as to enclose the inner tank within the outer tank with an insulating gap therebetween; and then preferably filling the insulating gap between said inner and outer tanks with a barrier insulation.

It is to be understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate one embodiment of the invention and together with the description serve to explain the principles of the invention.

DESCRIPTION OF THE PREFERRED EMBODIMENTS

Figure 1:
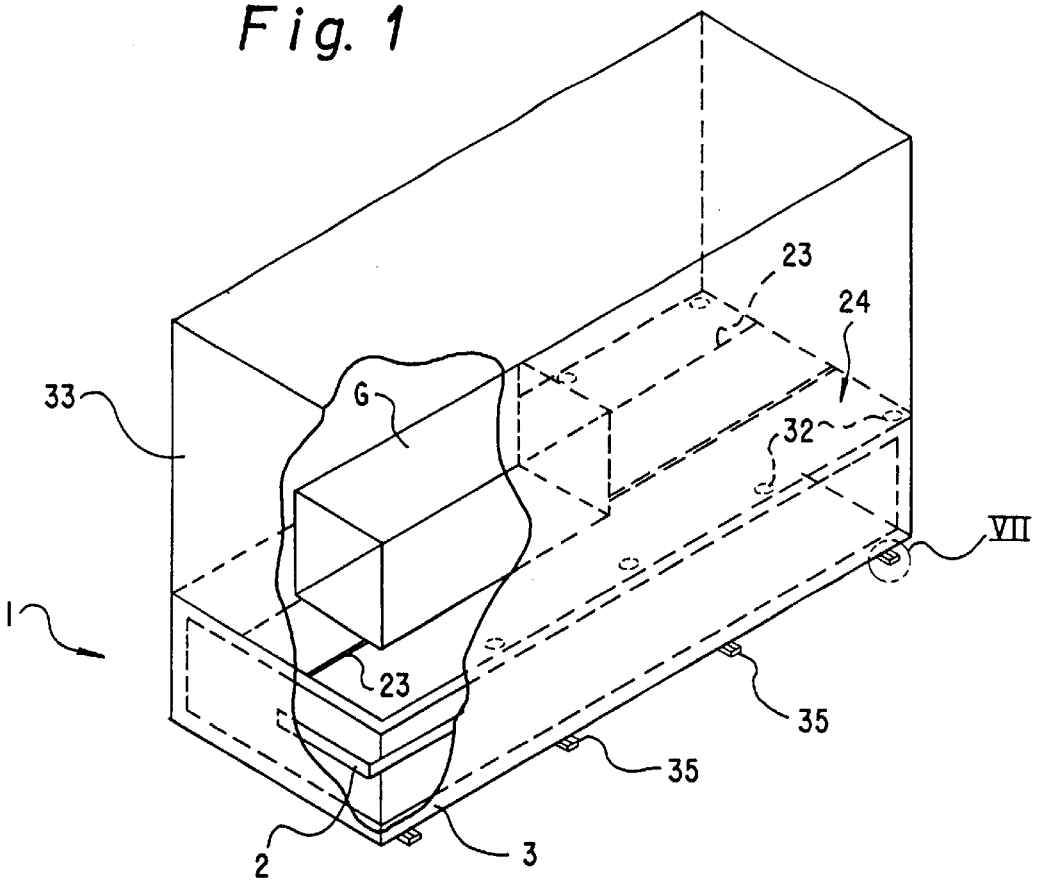
FIG. 1 is a perspective view of an embodiment of an above ground storage tank for holding a combustible material and for supporting equipment in accordance with the present invention.
Figure 2:
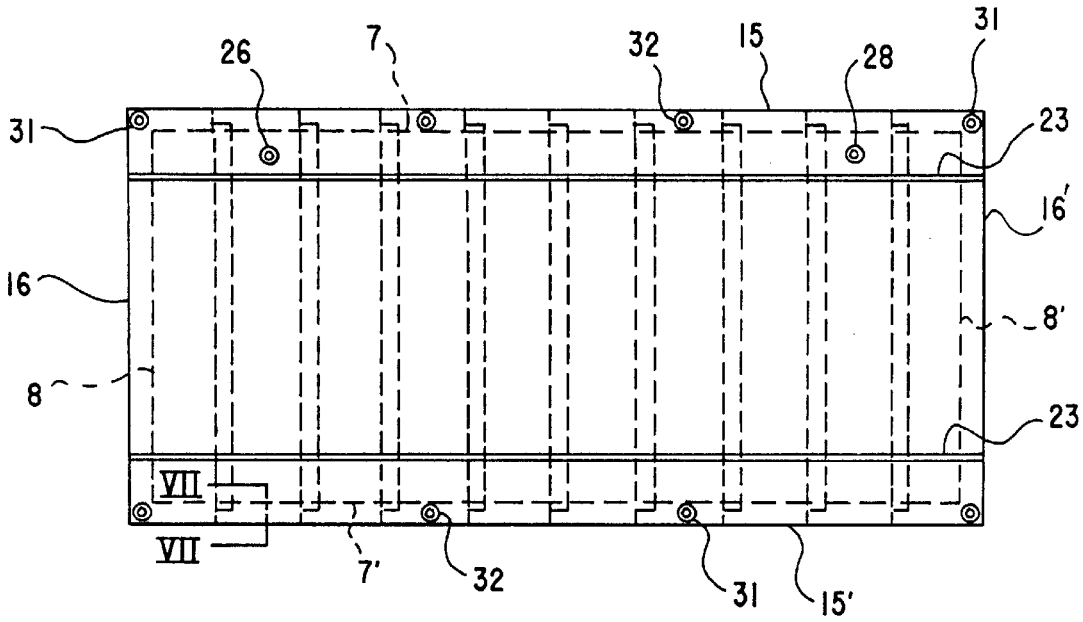
FIG. 2 is a top plan view of the above ground storage tank of FIG. 1 showing the stiffening members of the outer tank top wall on the inner surface thereof and the mounting members for equipment on the outer surface thereof.
Figure 3:
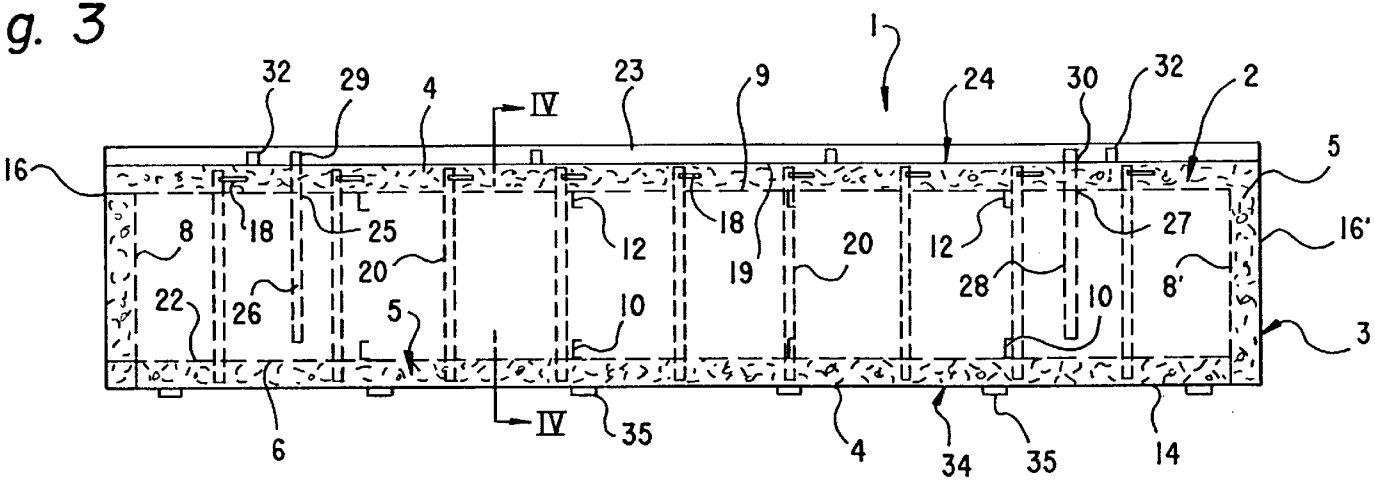
FIG. 3 is a side elevational view of the above ground storage tank of FIG. 1 showing side wall stiffening member on the inner surface of the side walls.

Reference will now be made in detail to the present preferred embodiments of the invention, examples of which are illustrated in the accompanying drawings, where like reference characters refer to like parts throughout the figures.

In accordance with the present invention an above ground liquid storage tank for holding a combustible material and supporting equipment thereon has an inner tank supported and disposed within an outer tank, with a barrier insulation preferably filling a gap between the inner and outer tanks, where the top wall of the outer tank has mounting beams extending therealong for supporting equipment on the above ground storage tank.

Figure 4:
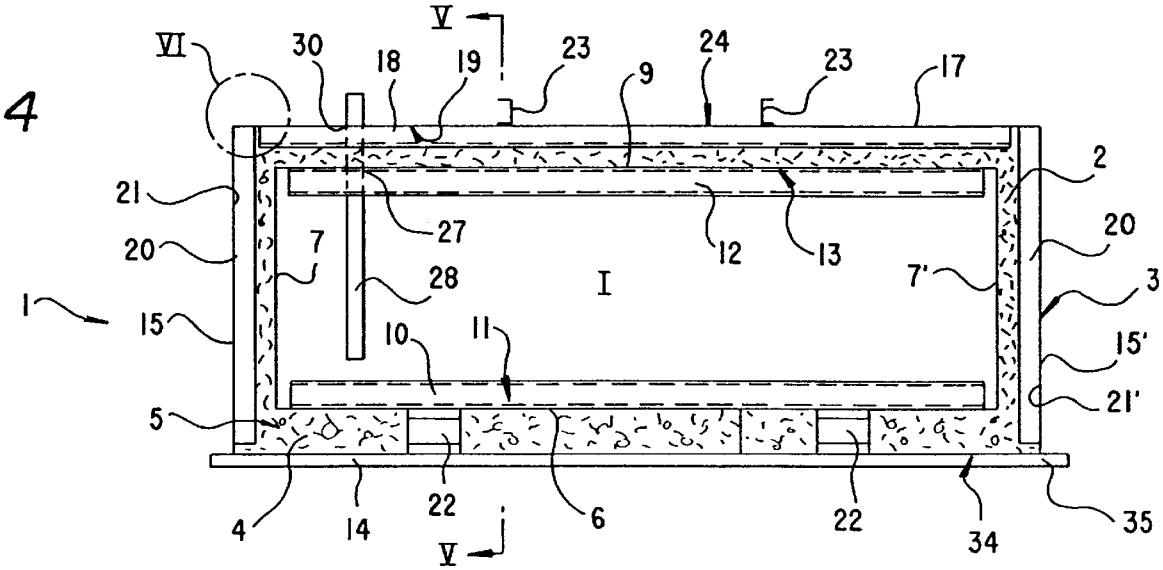
FIG. 4 is a sectional view taken along lines IV—IV of FIG. 3 showing the inner tank disposed within the outer tank.
Figure 5:
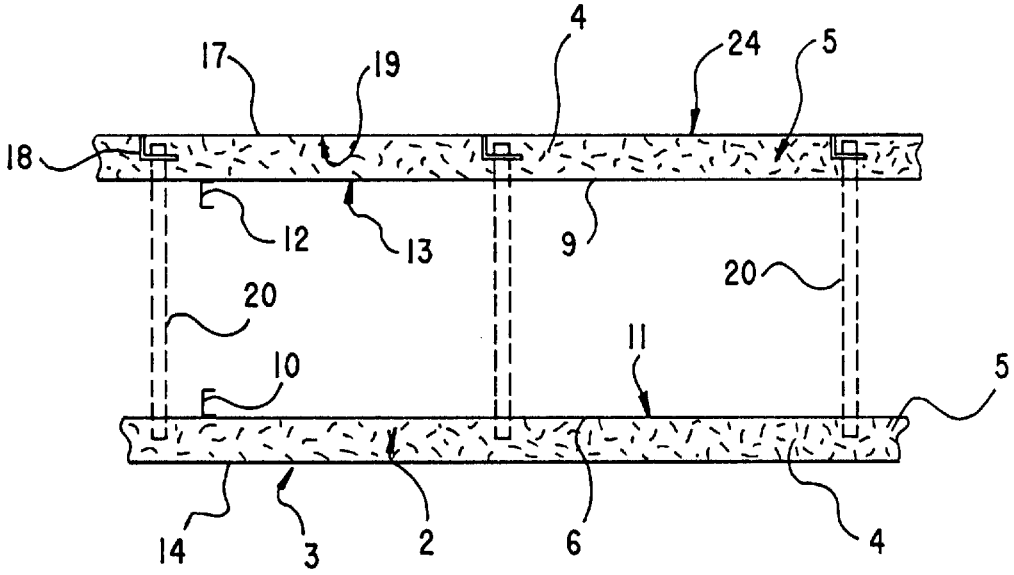
FIG. 5 is a sectional view taken along lines V—V of FIG. 4.
Figure 6:
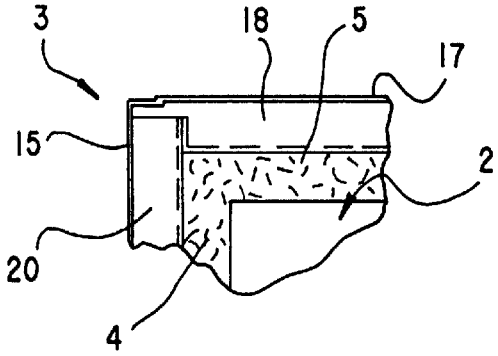
FIG. 6 is a view showing the alignment of the outer tank top wall stiffening members with the side wall stiffening members of the outer tank of the above ground storage tank shown in the circle VI of FIG. 4.
Figure 7:
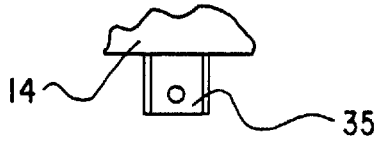
FIG. 7 is an enlarged view of the area in the circle VII of FIG. 1.

An exemplary embodiment of the above ground liquid storage tank of the present invention is shown in FIG. 1 and designated 1, which includes an inner tank 2 that is disposed within an outer tank 3 and preferably has barrier insulation 4 in an insulating gap 5 formed between the inner tank 2 and outer tank 3. The inner tank 2 is preferably formed from metallic skins that are welded together and strengthened by use of stiffening members, and may be a cylindrical tube or a rectangular tank, with the metallic skin construction and rectangular shape preferred and used in the following description. The inner tank may alternatively be formed from fiberglass or other composite material, which will safely retain the combustible material, with the stiffening members formed as integrally molded flanges thereon. As best illustrated in FIGS. 2–5, the inner tank 2 for containment of a combustible material, such as gasoline, has a bottom wall 6, opposed side walls 7, 7', opposed end walls 8, 8' and a top wall 9, all of which are secured together by welding of metallic skins that form the walls, at the outer peripheries thereof. A plurality of inner tank bottom wall stiffening members 10 are spaced along the inner surface 11 of the inner tank bottom wall 6. The stiffening members 10 used here and elsewhere can be any shape, such as an L-shape, rectangular, or are Z-bar shaped metallic members, and preferably are U-shaped metallic members, that are attached to the inner surface 11 of the inner tank bottom wall 6, such as by welding. As best shown in FIG. 4, the inner tank bottom wall stiffening members 10 extend substantially completely across the bottom wall 6 of the inner tank 2, between the side walls 7 and 7'. A plurality of top wall stiffening members 12 are also provided on the inner tank top wall 9, spaced along the inner surface 13 of the inner tank top wall 9, which stiffening members 12 are any shape, and preferably Z-bar shaped metallic members, or most preferably U-shaped metallic members, that are attached to the inner surface 13 of the inner tank top wall 9, such as by welding. The inner tank top wall stiffening members also extend substantially completely across the top wall 9 of the inner tank 2, between the side walls 7 and 7'. As an option, stiffening members can be attached to the inner surfaces of the side walls of the inner tank in a similar manner as with the top and bottom walls.

The outer tank 3, which encloses the inner tank 2, has a bottom wall 14, opposed side walls 15, 15', opposed end walls 16, 16' and a top wall 17, all of which are secured together, such as by welding of metallic skins that form the walls, at the outer peripheries thereof. A plurality of outer tank top wall stiffening members 18 are spaced along the inner surface 19 of the outer tank top wall 17, which stiffening members are preferably Z-bar shaped metallic members, or most preferably U-shaped metallic members, that are attached to the inner surface 19, such as by welding. A plurality of outer tank side wall stiffening members 20 are provided on the inner tank side walls 15, 15', spaced along the inner surface 21, 21' respectively, which stiffening members are any shape and preferably Z-bar shaped metallic members, or most preferably U-shaped metallic members, that are attached to the inner surfaces 21, 21' of the side walls 15, 15', such as by welding. As illustrated, the outer tank side wall stiffening members 20 are spaced along the inner surfaces 21, 21' of the outer tank side walls 15, 15' and are preferably in alignment with outer tank top wall stiffening members 18 on the outer tank top wall 17. The outer tank side wall stiffening members 20 extend vertically from outer top wall 17 substantially completely along the outer tank side walls 15, 15', while the outer tank top wall stiffening members 18 extend horizontally substantially completely across the outer tank top wall 17 between the outer tank side wall stiffening members 20.

The thickness of the metallic skins, used for the inner tank walls and the outer tank walls may vary from as thin as about 18 gauge through about ½" or more. The thickness of steel sheets forming the skins will depend on the overall volume of the tank and the density of the barrier insulation material. For small structures, using a very light barrier insulation, for example, the skins may be as thin as about 18 gauge. For larger structures where the barrier insulation is to be ordinary concrete, the skins may be as thick as about ½ inch. The stiffening members are welded either continuously or discontinuously to the metallic skins by any suitable welding process. Especially useful are metallic members such as 3"×5"×½ inch thick metallic angles, with the stiffening members evenly spaced from each other at 24" centers along the metallic skin. For a typical above ground storage tank of the present invention, the preferred maximum size would be about 10 feet wide, about 30 feet long, and about 4 feet in height, with a maximum volume of about 5,000 gallons of fuel and weight bearing capacity of about 200,000 pounds.

A supporting means, such as a plurality of metallic cradles 22, are provided between the bottom wall 6 of the inner tank 2 and the bottom wall 14 of the outer tank 3 which support the inner tank 2 in spaced relationship within the confines of outer tank 3 and provide an insulating gap 5 between the two bottom walls 6 and 14. The cradles 22 may be formed of metal, cement, concrete, or another durable, strong material or mixture of materials. According to an embodiment of the present invention, the cradles are metallic. The inner tank 2 is of a size such that it will fit inside the outer tank 3 with the insulating gap 5 provided which is preferably of a width of about 6 inches completely about the inner tank 2. The gap 5 is preferably filled with a barrier insulation 4. The type of insulation between the inner tank 2 and outer tank 3 will depend on the location and intended use of the structure, and is preferably a fire resistant material and most preferably also an impact resistant barrier insulation material. The fire resistant material is preferably one which is resistant to temperatures of about 2000° F. for a period of two hours. Such a fire resistant material may comprise various known materials such as Perlite, Vermiculite and fire retardant polymeric foam materials or ceramic or cementitious materials such as regular concrete, sand, or a cementitious material containing an aggregate. Preferably, a concrete material is used. The barrier insulating material is preferably impact resistant in addition to being fire resistant. As an optional embodiment, the gap 5 may be left empty and/or a barrier insulating material can be applied completely about outside of the outer tank 3.

The spacing between the inner tank 2 and the outer tank 3 can be determined as the height of the supporting cradles 22 that maintain the inner tank spaced from the outer tank. Preferably, the cradles 22 are secured to the inner surface of the bottom wall 14 of the outer tank 3, and preferably are also secured to the outer surface of bottom wall 6 of inner tank 2. Thus, when the insulating gap 5 is filled with a pourable composition, such as cement or concrete, the inner tank is secured to the outer tank by the cradles such that no floating of the inner tank away from the outer tank occurs.

The inner tank may be strapped, as with metal straps, to cradles secured to the inside bottom wall of the outer tank. When flexible straps are used, the inner tank can float on a pourable insulating material, such as concrete, to a desirable height. The straps can be adjusted or set to allow the inner tank to float to a desired height before further upward floatation is restrained by the straps.

In addition to providing for the safe storage of a combustible material above ground, the present tank provides for the supporting of equipment, such as an electric power generator, thereon. As illustrated, means for supporting equipment may include a plurality of mounting beams 23 which are secured to the outer surface 24 of the top wall 17 of outer tank 3. The mounting beams 23 preferably extend completely across the length of the outer tank 3, from end wall 16 to opposite end wall 16'.

The inner tank 2 has an inner tank inlet 25 thereon to which an inlet pipe 26 is connected with the interior chamber I thereof so as to enable filling of the inner tank 2 with a combustible material and an inner tank outlet 27 thereon to which an outlet pipe 28 is connected so as to enable discharge of combustible material from the interior of the inner tank 2 for use. The inlet pipe 26 and outlet pipe 28 pass through the gap 5, and barrier insulation 4, and through outer tank inlet opening 29 and outer tank outlet opening 30 in the outer tank top wall 17 and may be provided with closures or seals as desired.

A plurality of barrier insulation fill ports 31 are preferably formed through the outer tank top wall 17 which enables barrier insulation 4 to be charged to the gap 5 after the inner tank 2 has been disposed in the outer tank 3, such that the barrier insulator 4 surrounds the inner tank 2 and fills the barrier insulation gap 5. After filling of the gap 5 with barrier insulation, the ports 31 may be sealed.

A plurality of mounting tabs 32 are secured to the outer tank top wall 17, along the outer surface 24 thereof, which are spaced outside the mounting beams 23 and allow for securement of a housing 33 thereto which is provided to enclose and protect equipment, such as a generator G, that is supported by the mounting beams 23.

Along the outer tank bottom wall 14, attached to the outer surface 34, there are secured a plurality of spaced structural support feet 35 which are preferably evenly spaced from each other and extend between and beyond the outer tank side walls 15 and 15' (FIG. 4). The structural support feet support the tank 1 on the terrain for which it is to be used, supports the outer tank bottom wall away from the surface on which the tank is placed so as to reduce corrosion, and also provide additional strengthening of the outer tank bottom wall 14.

In the present above ground storage tank, the storage tank, with the spaced outer tank top wall stiffening members 18 preferably being in alignment with the outer tank side wall stiffening members 20 provides sufficient stiffening of the outer tank walls so as to enable placement of equipment on the top wall 17 of the outer tank 3.

In a prototype above-ground storage tank with rectangular shaped inner and outer tanks 2 and 3 and a six inch insulating gap 5 filled with lightweight concrete, the tanks used U-shaped stiffening members at 24 inch centers and had a approximate weight per square foot of surface area of about 35 pounds per square foot, which included ¼" steel plate or metallic skins for the inner tank 2 of about 10.2 pounds per square foot, 6 inches of lightweight concrete of about 12.5 pounds per square foot, 3/16" steel plate as metallic skins for the outer tank 3 of about 7.65 pounds per square foot, and stiffening members of about 4.65 pounds per square foot. The prototype was about 4 feet in height, 10 feet in width and 30 feet in length, with a six inch concrete barrier insulation between inner and outer tanks 2 and 3. The inner tank 2 had a capacity of about 6000 gallons. The prototype tank was subjected to a fire test by being heated to an outer temperature of 2000° F. over a two hour period. The inner tank temperature did not exceed 239° F. showing excellent fire resistance. The prototype was subjected to an interstitial communication test with 5 pounds per square inch pressure applied to the inner tank, with a 5 pound per square inch pressure recorded at the monitoring point in less than 24 hours. Next, the panel was subjected to a projectile test, with 5 shots of 150 grain, ball, .30 caliper, copper jacket ammunition, having a nominal muzzle velocity of 2700 ft/sec. fired from a distance of 100 feet. Bullet velocity was monitored and recorded for two shots fired prior to the test. The bullet was fired perpendicular to the point of impact on the tank wall. (For samples with a slight curvature, the shots were fired perpendicular to the midpoint of the panel). The five shots were placed in an approximate 3 foot by 3 foot area.

Following this test, the prototype was examined for signs of damage and penetration. There was no sign of damage or penetration through the concrete insulation. Therefore, the insulation system would protect a primary or inner tank from damage which would affect the tank's ability to remain leak tight.

Finally, after being subjected to the Fire Test of Interstitial Insulation and the Projectile Test, the anchored prototype was subjected to a single impact from a 12,000 lb. weight hung from a crane travelling at approximately 10 mph. The test tank was impacted 18 in. above the bottom of the tank with a one foot square impact surface. The test was conducted on a surface of the tank not subjected to the Projectile Impact Test. Following this, a Leakage Test was conducted. There was no evidence of damage or leakage.

In a further embodiment of the above ground storage tank, intermediate top wall, side walls, end walls and bottom wall may be provided between the outer tank walls and the inner tank walls so as to provide a supplemental insulating gap in addition to the insulating gap 5. Use of such an intermediate wall system is described in U.S. Pat. No. 4,989,750, the contents of said patent being incorporated by reference herein. In addition, or in the alternative, an impervious plastic membrane, such as a low density polyethylene sheet may be disposed completely about the inner tank 2 so as to encapsulate the inner tank 2 and retain any leakage of combustible material, such as fuel, therefrom. Use of such a membrane is described in U.S. Pat. No. 5,282,546, the contents of said patent being incorporated by reference herein. Also, if desired, a leak detection monitoring system may be provided between the inner and outer tanks.

In accordance with the present invention, the method of fabricating an above ground storage tank 1, for holding a combustible material and for supporting equipment thereon, comprises providing an inner tank 2 for containment of a combustible material, the inner tank having a bottom wall 6, opposed side walls 7 and 7', opposed end walls 8 and 8', and a top wall 9, all of which are formed of a metallic skin and are welded together about the peripheries thereof to form an interior chamber I. The bottom wall 6 of the inner tank 2 has a plurality of spaced horizontally extending bottom wall stiffening members 10 extending substantially completely across the bottom wall 6 between the side walls 7 and 7', and are preferably welded to the inner surface 11 thereof. The top wall 9 of the inner tank 2 has a plurality of spaced horizontally extending top wall stiffening members 12 extending substantially completely across the top wall 9 between the side walls 7 and 7', and are preferably welded to the inner surface 13 thereof. The inner tank top wall 9 also has at least one inlet 25 with an inlet pipe 26 connected thereto and at least one outlet 27 with an outlet pipe 28 connected therewith, which inlet pipe 26 and outlet pipe 28 extend outwardly from the top wall 9 and communicating with the interior chamber I. The inner tank 2 may be assembled on site or it may be preassembled and delivered to the site of fabrication of the above ground storage tank 1.

An outer tank bottom wall 14 is then provided, the bottom wall formed as a metallic skin and a support means, such as metallic cradles 22, are secured, such as by welding, to the inner surface thereof. To the periphery of the outer tank bottom wall 14 there are then secured, such as by welding, upwardly extending opposed side walls 15 and 15' to which have been welded, preferably to the inner surface 21 thereof, side wall stiffening members 20, and opposed upwardly extending end walls 16 and 16', which also have side wall stiffening members 20. The side walls 15 and 15' and end walls 16 and 16' are welded to the outer tank bottom wall 14 and to each other to form a box-like shape forming a cavity. The inner tank 2 is then positioned in the cavity formed by the outer tank bottom wall 14, side walls 15, 15', and end walls 16, 16', and on metallic cradles 22 so as to provide an insulating gap 5 between the bottom wall 14 and the bottom wall 6 of inner tank 2, between the side walls 15, 15' and the side walls 7 and 7' of the inner tank 2, and between the end walls 16, 16' and the end walls 8 and 8' of the inner tank 2, and also so as to provide insulating gap 5 formed between the top wall 9 of inner tank 2 and a plane formed across the upper edges of the side walls 15, 15' and end walls 16, 16' of the outer tank 3. The top wall 17 of the outer tank 3 is then placed on the side walls 15, 15' and 16, 16' and welded thereto, with the inlet pipes 26 and outlet pipes 28 passing through the outer tank inlet opening 29 and outer tank outlet opening 30 in the outer tank top wall 17. The inner tank 2 is thus enclosed within the outer tank 3 with an insulating gap 5 formed between the inner tank 2 and outer tank 3. A barrier insulation 4 is preferably then poured through barrier insulation fill ports 31 and the gap 5 is filled with the barrier insulation 4.

Figure 8:
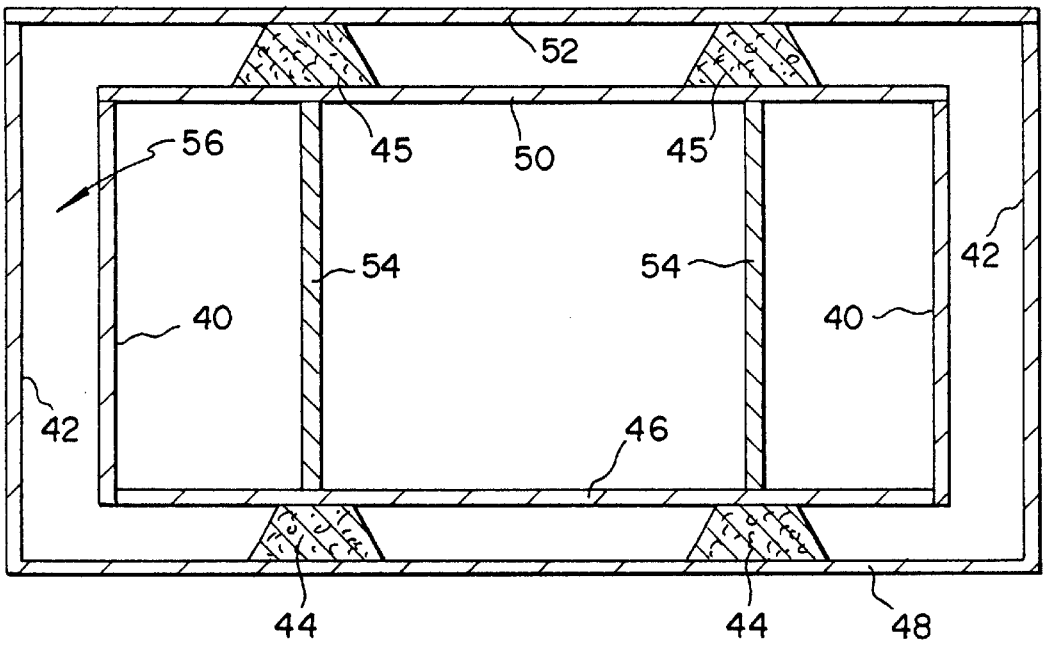
FIG. 8 is a cross-sectional side view of an above-ground storage tank according to yet another embodiment of the present invention.

Other features of the present invention are shown in the embodiment of FIG. 8. As can be seen in FIG. 8, the above ground storage tank can comprise an inner tank 40 and an outer tank 42 that are spaced from each other by precast concrete standoffs or spacers 44, 45. The spacers can be of trapezoidal or other cross-section and can extend the width of the inner tank from adjacent to or contacting one side wall to adjacent to or contacting the opposing side wall. Preferably, two or more spacers 44 are used to space the bottom wall 46 of inner tank 40 from the bottom wall 48 of outer tank 42. Preferably, two or more spacers 45 are used to space top wall 50 of inner tank 40 from top wall 52 of outer tank 42. Although concrete is a preferred material for the spacers, other materials may be used including cement, metal, plastic, or stone. As shown in FIG. 8, the outer surface of bottom wall 46 rests on the top surfaces of the lower spacers 44, and the bottom surfaces of the lower spacers 44 rest on the inner surface of bottom wall 48. After the lower spacers 44 and inner tank are disposed within the outer tank, the upper spacers 45 and outer tank top wall 52 are then positioned to complete the hollow assembly shown. The bottom surfaces of the upper spacers 45 preferably rest on the outer surface of top wall 50, and the inner surface of top wall 52 preferably rests on the top surfaces of the upper spacers 45. The insulating gap 56 can then be filled with an insulating material, for example, a cement or concrete material.

Vertical stiffening or baffle members are disposed along the inner walls of inner tank 40 and extend between opposing pairs of spacers 44, 45 as shown in FIG. 8. The stiffening members 54 are preferably disposed within inner tank 40, in contact with the bottom wall 46 and top wall 50 of the inner tank, and spaced from the inner tank vertical side walls and end walls. Preferably, the stiffening members 54 are disposed adjacent a central portion of the respective standoffs 44, 45 such that weight from above the inner tank can be transferred from spacers 45 through stiffening members 54 to spacers 44 without deforming the inner tank. The stiffening members 54 can be any shape as long as the members stiffen the inner tank and optionally the outer tank, such as angle-shaped, channel-shaped, U-shaped, or corrugated rods, poles, beams, tubes, baffles, or porous walls. Other details of the above ground storage tank of FIG. 8, such as those shown with respect to the embodiments of FIGS. 1–7, would also be included although not shown.

Figure 9:
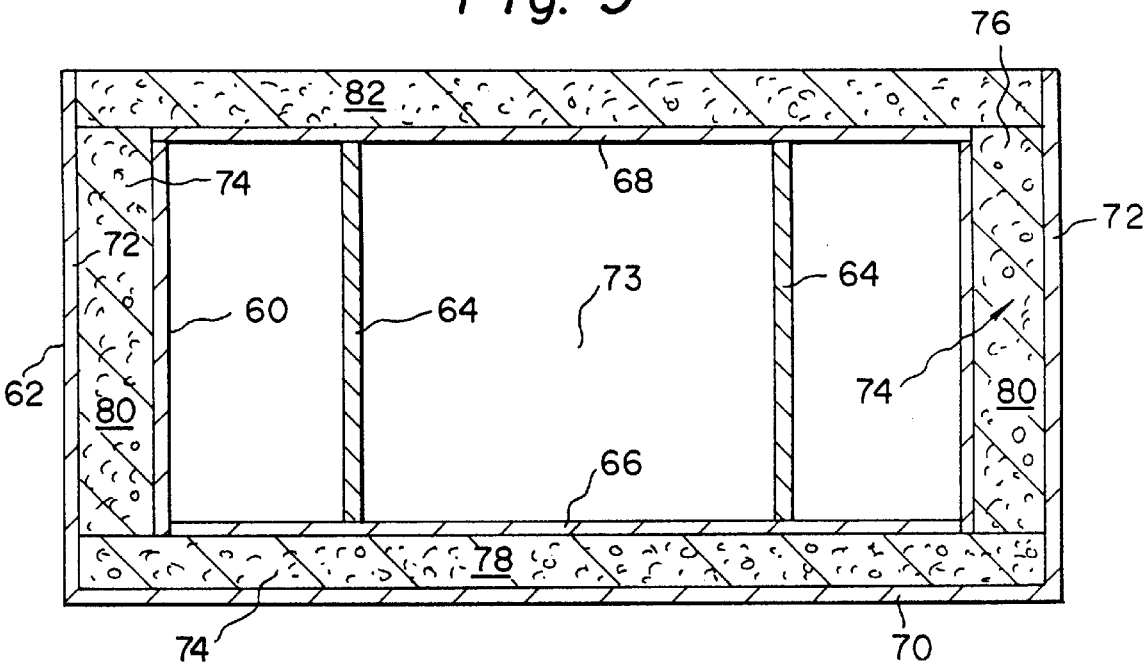
FIG. 9 is a cross-sectional side view of yet another embodiment of the present invention.

According to the embodiment of FIG. 9, an above ground storage tank according to the present invention is provided with an inner tank 60, an outer tank 62, and stiffening members 64 for supporting the bottom wall 66 and the top wall 68 of inner tank 60 and for maintaining the walls in a fixed spaced relation. As shown in FIG. 9, outer tank 62 is not provided with a top wall but rather includes only a bottom wall 70, end walls 72, and side walls 73. According to the embodiment of FIG. 9, the insulating gap 74 formed between the inner tank 60 and the outer tank 62 is filled with an insulation material, for example, a concrete material.

To ensure a desired spacing of the inner tank 60 from the outer tank 62, a bottom layer of insulating material 78 is first poured and set in outer tank 62 before inner tank 60 is placed within the outer tank. After the bottom layer 78 of insulating material is hardened within outer tank 62, the inner tank 60 is placed within outer tank 62 such that the lower surface of bottom wall 66 rests on top of the insulating layer 78. Thereafter, the inner tank 60 may be secured to the bottom layer 78 or otherwise secured in a spaced relationship to outer tank 62. Then, insulating layers 80 are poured and formed between the side walls and end walls of inner tank 60 and outer tank 62. Depending upon the weight of inner tank 60 and the displacement capability of the insulating material used to form the vertical insulating layers 80, the inner tank 60 may tend to float within the uncured insulating material used to form insulating layers 80. If the inner tank 60 is light enough to float within the uncured insulating material, it is necessary to secure the inner tank 60 to insulating layer 78 and/or outer tank 62 to ensure proper spacing of inner tank from outer tank 62.

After the insulating layers 80 are formed between the side walls and end walls of the inner tank 60 and outer tank 62, a top layer of insulating material 82 can be formed on top of top wall 68 and insulating layers 80, to complete the enclosure of inner tank 60. Other details of the above ground storage tank of FIG. 9, such as those shown with respect to the embodiments of FIGS. 1–8, may also be included although not shown. The insulation material, in this embodiment, is strong enough to support equipment resting on top of the cured insulation material which encapsulates the inner tank. The insulation material will preferably be filled to the top edge of the side walls of the outer tank. Otherwise, the inner tank and outer tank will have the same features and structure as described earlier in other embodiments.

The present invention thus provides an above ground storage tank, and method of manufacture thereof that can be used to store a combustible material and also to support equipment, such as an electric power generator, thereon.

It will be apparent to those skilled in the art that various modifications and variations can be made in the apparatus and method of the present invention without departing from the period or scope of the invention. Thus it is intended that the present invention cover the modifications and variations of this invention provided they come within the scope of the appended claims and their equivalents.

What is claimed is:

1. A method of fabricating an above ground storage tank for holding a combustible material and for supporting equipment thereon, comprising:

providing an inner tank for containment of a combustible material, said inner tank having a bottom wall, opposed side walls, opposed end walls, and a top wall, with a plurality of inner tank bottom wall stiffening members spaced along the bottom wall extending substantially completely across the bottom wall, and a plurality of inner tank top wall stiffening members spaced along the top wall extending substantially completely across the top wall;

providing an outer tank metallic bottom wall having spaced support means on an upper surface thereof, with opposed vertically upwardly extending metallic side walls and metallic end walls, said side walls and end walls welded to the bottom wall about the periphery thereof and to each other to form a cavity;

positioning said inner tank in said cavity and on said support means so as to provide an insulating gap between said inner tank and the bottom wall, side walls, and end walls of said outer tank with an insulating gap also provided between the top wall of said inner tank and a plane formed across the upper edges of the side walls and end walls of the outer tank;

filling the insulating gap between the inner tank and the bottom wall, side walls, and end walls of said outer tank with an insulating material;

filling the insulating gap between the top wall of said inner tank and the plane formed across the upper edges of the side walls and end walls of the outer tank with a hardenable insulating material; and hardening the insulating material.

2. The method of claim 1, wherein said hardenable insulating material is a cement or concrete material.

3. The method of claim 1, further comprising welding a top wall, having means on an outer surface thereof for supporting equipment thereon to the upper edges of the side walls and end walls of said outer tank so as to enclose the inner tank within the outer tank with an insulating gap therebetween.

4. A method of fabricating an above ground storage tank, for holding a combustible material and for supporting equipment thereon comprising:

providing an inner tank for containment of a combustible material, said inner tank having a bottom wall, opposed side walls, opposed end walls, and a top wall, with a plurality of inner tank bottom wall stiffening members spaced along the bottom wall extending substantially completely across the bottom wall, and a plurality of inner tank top wall stiffening members spaced along the top wall extending substantially completely across the top wall;

providing an outer tank metallic bottom wall having spaced support means on an upper surface thereof, with opposed vertically upwardly extending metallic side walls and metallic end walls, said side walls and end walls welded to the bottom wall about the periphery thereof and to each other to form a cavity;

positioning said inner tank in said cavity and on said support means so as to provide an insulating gap between said inner tank and the bottom wall, side walls, and end walls of said outer tank with an insulating gap also provided between the top wall of said inner tank and a plane formed across the upper edges of the side walls and end walls of the outer tank;

positioning second support means on said inner tank top wall for supporting an outer tank top wall thereon; and welding a top wall, having means on an outer surface thereof for supporting equipment thereon, to the upper edges of the side walls and end walls of said outer tank so as to enclose the inner tank within the outer tank with an insulating gap therebetween.

5. The method of claim 4, wherein said support means and said second support means comprise precast cement or concrete spacing elements.

6. The method of claim 5, wherein at least one second stiffening member is provided in said inner tank vertically arranged to maintain a spacing between at least one respective pair of a support member and a second support member.

7. The method of claim 4, further comprising forming a layer of insulating material in the bottom of said outer tank prior to positioning said inner tank in said cavity;

filling the insulating gap between the inner tank side walls and end walls and the outer tank side walls and end walls with an insulating material after positioning said inner tank in said cavity; and thereafter filling the insulating gap between the top wall of said inner tank and the plane formed across the upper edges of the side walls and end walls of the outer tank, with an insulating material.

8. The method of claim 7, wherein said insulating material comprises cement or concrete material.

9. The method of claim 7, wherein said insulating material is hardenable and said method comprises hardening said insulating material between the inner tank side walls and end walls and the outer tank side walls and end walls before filling the insulating gap between the top wall of said inner tank and the plane formed across the upper edges of the side walls and end walls of the outer tank.

10. A method of fabricating an above ground storage tank, for holding a combustible material and for supporting equipment thereon, comprising:

providing an inner tank for containment of a combustible material, said inner tank having a bottom wall, opposed side walls, opposed end walls and a top wall, with a plurality of inner tank bottom wall stiffening members spaced along the bottom wall extending substantially completely across the bottom wall and a plurality of inner tank top wall stiffening members spaced along the top wall extending substantially completely across the top wall;

providing an outer tank metallic bottom wall, having spaced support means on an upper surface thereof, with opposed vertically upwardly extending metallic side walls and metallic end walls, said side walls and end walls welded to the bottom wall about the periphery thereof and to each other to form a cavity;

positioning said inner tank in said cavity and on said support means so as to provide an insulating gap between said inner tank and the bottom wall, side walls and end walls of said outer tank with an insulating gap also provided between the top wall of said inner tank and a plane formed across the upper edges of the side walls and end walls of the outer tank; and welding a top wall, having means on an outer surface thereof for supporting equipment thereon, to the upper edges of the side walls and end walls of said outer tank so as to enclose the inner tank within the outer tank with an insulating gap therebetween.

11. The method of fabricating an above ground storage tank as defined in claim 10, including the step of filling said insulating gap between said inner and outer tanks with a fire resistant material.

12. The method of fabricating an above ground storage tank as defined in claim 11, wherein said fire resistant material is also impact resistant.

13. The method of fabricating an above ground storage tank as defined in claim 10 including welding metallic cradles on the upper surface of said outer tank bottom wall as said support means.

14. The method of fabricating an above ground storage tank as defined in claim 10 including welding mounting beams on the outer surface of said outer tank top wall as said means for supporting equipment.

15. The method of fabricating an above ground storage tank as defined in claim 14 including mounting an electric power generator on said mounting beams and enclosing said electric power generator with a housing secured to said outer tank top wall.

* * * * *